United States Patent [19]

Keller

[11] Patent Number: 4,728,014

[45] Date of Patent: Mar. 1, 1988

[54] SLIDING CLOSURE UNIT WITH IMPROVED PLATE PRESSING STRUCTURE

[75] Inventor: Werner Keller, Steinhausen, Switzerland

[73] Assignee: Stopinc Aktiengesellschaft, Baar, Switzerland

[21] Appl. No.: 813,554

[22] Filed: Dec. 26, 1985

[30] Foreign Application Priority Data

Jan. 12, 1985 [DE] Fed. Rep. of Germany ..... 3500863

[51] Int. Cl.[4] ..... B22D 41/08; B22D 37/00

[52] U.S. Cl. ..... 222/600; 222/606; 222/512

[58] Field of Search ..... 222/512, 514, 599, 600, 222/513, 598; 266/220, 268, 271, 272; 164/437

[56] References Cited

U.S. PATENT DOCUMENTS

| | | | |
|---|---|---|---|
| 3,587,945 | 6/1971 | Lanatti | 222/512 X |
| 3,730,401 | 5/1973 | Bode, Jr. | 222/512 |
| 3,764,047 | 10/1973 | Inoue et al. | 222/598 |
| 3,799,424 | 12/1973 | Shaplano, Jr. | 222/512 X |
| 4,543,981 | 10/1985 | Bates et al. | 222/598 X |
| 4,577,785 | 3/1986 | Wakabayashi | 222/512 X |
| 4,650,101 | 3/1987 | Fricker | 222/512 X |

FOREIGN PATENT DOCUMENTS

| | | | |
|---|---|---|---|
| 359664 | 11/1980 | Austria . | |
| 1299804 | 7/1969 | Fed. Rep. of Germany . | |
| 2212312 | 5/1973 | Fed. Rep. of Germany . | |
| 772715 | 10/1980 | U.S.S.R. | 222/600 |
| 1053961 | 11/1983 | U.S.S.R. | 222/600 |

*Primary Examiner*—Joseph J. Rolla
*Assistant Examiner*—Gregory L. Huson
*Attorney, Agent, or Firm*—Wenderoth, Lind & Ponack

[57] ABSTRACT

A sliding closure unit for controlling the discharge of molten metal from a metallurgical vessel includes a stationary refractory plate, a stationary housing assembly for mounting the stationary refractory plate on the metallurgical vessel, a movable refractory plate, the stationary and movable refractory plates having complementary, abutting relative sliding surfaces, and a movable frame mounting the movable refractory plate for movement with respect to the stationary refractory plate. The movable frame and movable refractory plate are urged toward the stationary refractory plate by levers mounted in the housing assembly for pivotal movement about axles fixed to the housing assembly and extending transverse to the direction of movement of the movable frame and movable refractory plate. Springs are mounted in the housing assembly to urge the levers to pivot about the respective axles toward the movable frame to thereby urge the movable frame and movable refractory plate toward the stationary refractory plate. Each lever and the respective spring are arranged in an elongated configuration extending in a direction substantially parallel to the direction of movement.

11 Claims, 5 Drawing Figures

SLIDING CLOSURE UNIT WITH IMPROVED PLATE PRESSING STRUCTURE

BACKGROUND OF THE INVENTION

The present invention relates to an improved slide gate or sliding closure unit for controlling the discharge of molten metal from an outlet nozzle of a metallurgical vessel, particularly a steel foundry ladle, the sliding closure unit being of the type including a stationary refractory plate having therethrough a discharge opening aligned with the outlet nozzle of the vessel, a stationary housing assembly for mounting the stationary refractory plate on the metallurgical vessel, a movable refractory plate having therethrough a discharge opening, the stationary and movable refractory plates having complementary, abutting relative sliding surfaces, a movable frame mounting the movable refractory plate for movement with respect to the stationary refractory plate to bring the discharge opening of the movable refractory plate into and out of alignment with the discharge opening of the stationary refractory plate, and means for pressing the movable refractory plate toward the stationary refractory plate to ensure sealing between the complementary, abutting relative sliding surfaces.

Typically, such pressing means is in the form of spring loaded rocking or pivotable levers having support or contact members which are urged against, for example, guide tracks of the movable frame, thereby urging the movable frame and movable refractory plate toward the stationary refractory plate. These types of arrangements are disclosed in DE-AS 1,299,804 with respect to a movable refractory plate which is movable rectilinearly and in DE-OS 22 12 312 with respect to a movable refractory plate which is mounted for rotary movement. In such arrangements, the levers are mounted to extend generally perpendicularly to the direction of movement of the movable refractory plate. Thus, these levers are mounted with the support or contact ends beneath the movable frame and with opposite, spring-loaded ends extending outwardly therefrom. As a result of this arrangement, the overall sliding closure unit is of a relatively cumbersome design requiring a substantially large amount of space which only rarely is available. A further disadvantage of this conventional arrangement is that the levers are mounted in a manner which does not provide adequate stability to withstand the pressures necessary to ensure tight sealing between the two refractory plates.

Additionally, Austrian Pat. No. 359,664 discloses a sliding closure unit having a rectilinearly movable frame guided on rollers between two rocker-type frames, each mounted to oscillate on a swing-out lever. Spring buffers and a cross brace are provided on free ends of the levers and, during clamping of the levers against a housing structure by means of snap closures, the spring buffers cause the movable refractory plate to be pressed sealingly against the stationary refractory plate. With this construction, the rocker-type frames provided externally of the movable frame result in a relatively wide and high overall structure. Additionally, the contact pressure by the spring buffers mounted on an end face of the unit is applied in an asymmetric and indirect fashion via the levers which are exposed to strong torsional forces.

SUMMARY OF THE INVENTION

With the above discussion in mind, it is an object of the present invention to provide a sliding closure unit with improved plate pressing structure whereby it is possible to overcome the above and other prior art disadvantages.

It is a more specific object of the present invention or provide such improved plate pressing structure achieving an improved contact pressure of the movable refractory plate against the stationary refractory plate.

It is a further object of the present invention to provide such an improved plate pressing structure having a simplified configuration and designed in a space-saving manner and of smaller dimensions than in conventional arrangements.

These objects are achieved in accordance with the present invention by the provision that the plate pressing structure includes levers mounted in the housing assembly for pivotal movement about axles fixed to the housing assembly and extending transverse to the direction of movement of the movable frame and the movable refractory plate. Springs are mounted in the housing assembly and urge the levers to pivot about the respective axles toward the movable frame to urge the movable frame and movable refractory plate toward the stationary refractory plate. Each lever and the respective spring is arranged in an elongated configuration extending in a direction substantially parallel to the direction of movement. By this structural arrangement, it is possible to ensure that in any relative position of the movable frame, there is imparted an optimal sealing contact pressure of the movable refractory plate against the stationary refractory plate. Furthermore, this structural arrangement provides a simple, maintenance-free design with a space-saving structure enabling the provision of an overall compact sliding closure unit.

These advantages particularly result when the housing assembly includes a housing member fixed to the metallurgical vessel and a cover member pivotally mounted on the housing member for movement relative thereto between open and closed positions, with the levers, axles and springs being mounted within the cover member, and at least the levers being positioned below or outwardly of a guide track or tracks of the movable frame.

In one particular embodiment of the present invention, the movable frame is movable rectilinearly, and rectilinear guide tracks are located at each of opposite sides of the movable frame to extend parallel to the direction of movement. Two levers and respective springs are positioned beneath or outwardly of each guide track, and each lever has at a first end thereof a contact member urged by the respective spring into abutment with the respective guide track. The contact members all are located symmetrically with respect to the discharge opening of the stationary refractory plate, the two levers associated with each guide track are positioned with the first ends thereof directed toward each other, and the springs are positioned in the cover member at locations beyond the path of movement of the movable frame. Due to the symmetric arrangement of the contact members, there will be a symmetric contact pressure directly around the discharge opening in the stationary refractory plate, and this will be achieved at all relative positions of the movable frame and movable refractory plate.

In accordance with a further embodiment of the present invention, the movable frame and movable refractory plate are mounted for rotary or swivel movement about an axis, and the axles pivotally supporting the levers and/or axles of the support members are arranged to extend radially of such axis. This provides a uniform and fool-proof application of uniform pressure and enables the levers to be mounted beneath a curved guide track.

BRIEF DESCRIPTION OF THE DRAWINGS

Other objects, features and advantages of the present invention will be apparent from the following detailed description of preferred embodiments thereof, with reference to the accompanying drawings, wherein.

DETAILED DESCRIPTION OF THE INVENTION

Figure 1:
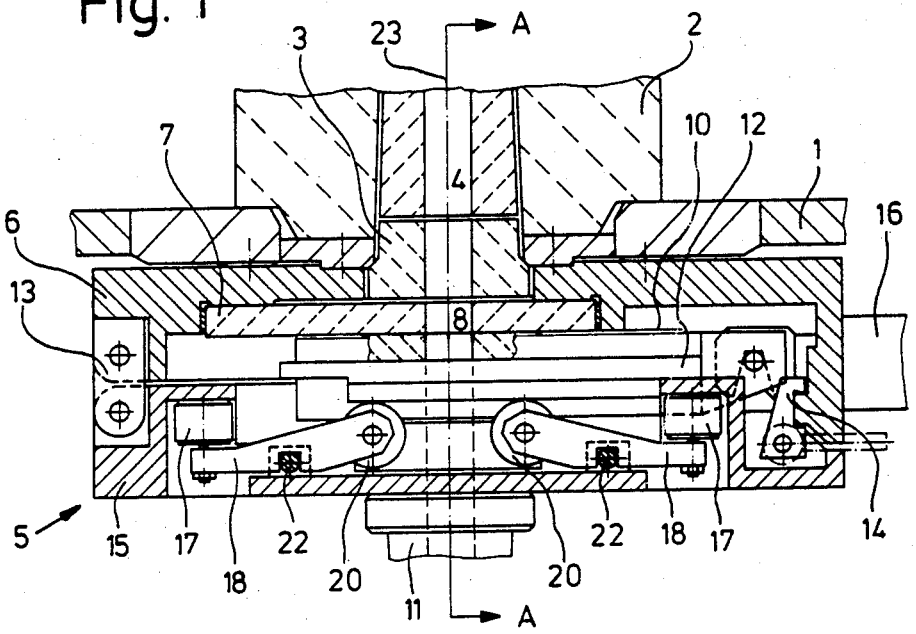
FIG. 1 is a longitudinal sectional view through a sliding closure unit according to the present invention, the movable refractory plate being rectilinearly movable.
Figure 2:
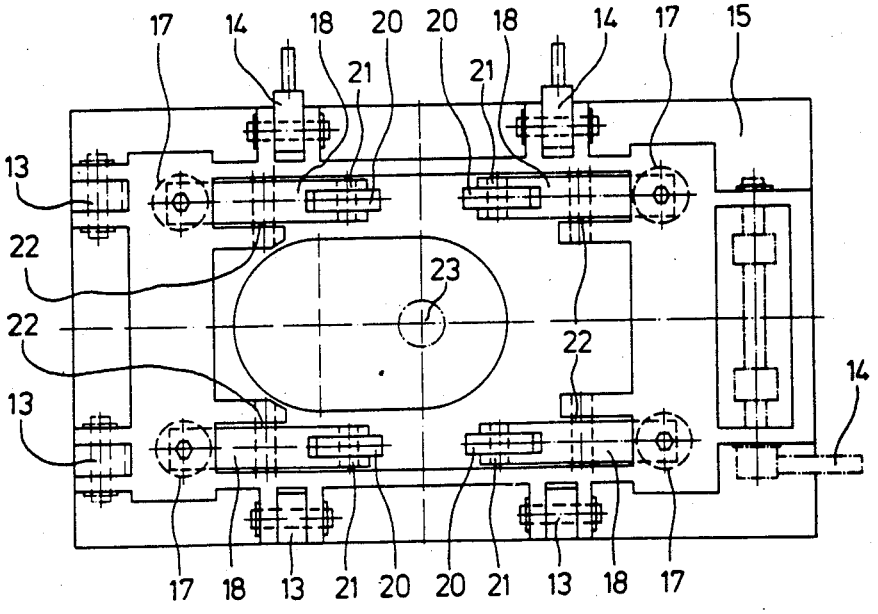
FIG. 2 is a plan view of a cover member shown in FIG. 1.
Figure 3:
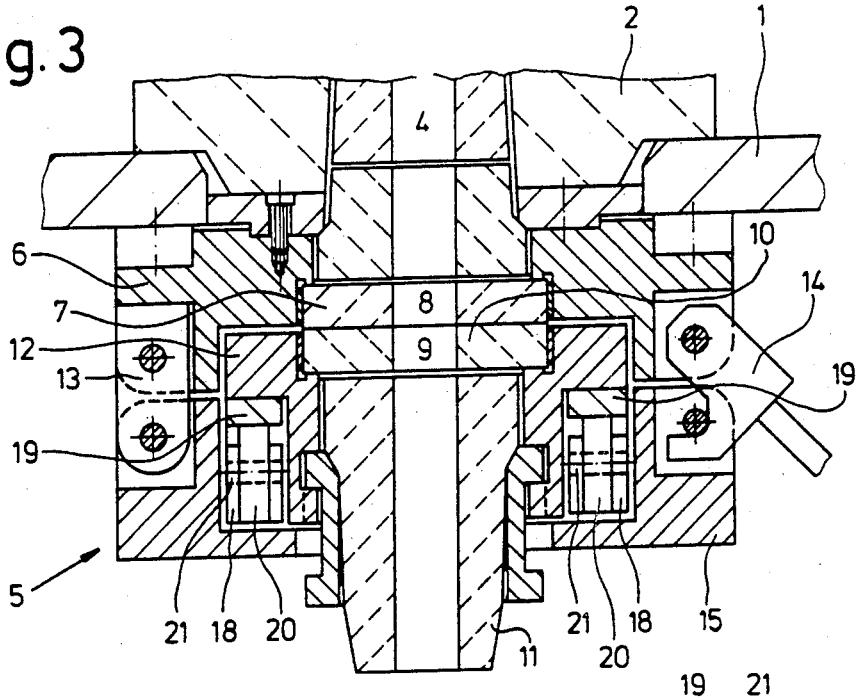
FIG. 3 is a cross-sectional view taken along line A—A of FIG. 1.

With reference to FIGS. 1–3, a first embodiment of the present invention will be described. Thus, illustrated is a portion only of a bottom of a metallurgical vessel including an outer metal jacket 1 having inwardly thereof a refractory lining (not shown) having extending therethrough a perforated nozzle brick 2 into which extends a two-part inlet sleeve or nozzle 3 the outlet orifice or opening 4 of which forms an inlet into a sliding closure unit 5 according to the present invention.

Such unit includes a stationary housing assembly including a housing member 6 removably fastened to metal jacket 1, a stationary refractory plate 7 mounted in housing member 6 and having a discharge opening 8 aligned with outlet orifice 4. A movable refractory plate 10 has therethrough a discharge opening 9 and is mounted against refractory plate 7 such that the two plates 7, 10 have complementary, abutting relative sliding surfaces. A movable frame 12 mounts movable refractory plate 10 for movement with respect to stationary refractory plate 7, for example by means of a power source 16 shown only schematically in FIG. 1. A refractory discharge nozzle 11 is mounted in abutment with movable refractory plate 10, for example by means of a bayonet connection illustrated somewhat schematically in FIG. 3. The housing assembly further includes a cover member 15 which is pivotally mounted on housing member 6 by means of hinges 13 and pivotal locking levers 14. The construction of the mounting of cover member 15 to housing member 6 is illustrated in the drawings and does not in and of itself constitute a portion of the present invention, but rather the invention of a copending U.S. application entitled "APPARATUS FOR RELIEVING THE PRESSURE OF CLAMPING SPRINGS IN A SLIDING CLOSURE UNIT", filed concurrently herewith by Hans Müller and assigned to the assignee of the present application. The disclosure of such copending application is incorporated herein by reference.

Power source 16 moves frame 12 and movable refractory plate 10 rectilinearly, and this movement is guided within the housing assembly. The movable frame 12 and movable refractory plate 10 are urged toward the stationary refractory plate 7 to ensure a sealing contact between the complementary abutting sliding surfaces of the two plates, thereby to provide a satisfactory seal therebetween to prevent leakage therebetween of molten metal.

Such pressing structure includes, on each side of frame 12, a pair of rocking levers 18 mounted within the housing assembly, and specifically within cover member 15, for pivotal movement about axles 22 fixed to cover member 15 and extending in directions transverse to the direction of movement of movable frame 12 and movable refractory plate 10. Each lever 18 as illustrated is a double-arm lever, a first end of which is acted on by a respective spring 17 mounted within cover member 15 to urge a second arm of the lever to pivot about axle 22 to urge a contact member 20 into abutment with a guide track 19 mounted along the respective side of a frame 12. Guide tracks 19 extend rectilinearly and parallel to the direction of movement of the frame 12. Guide tracks 19 serve both to laterally guide the frame with respect to cover member 15 and to provide bearing or contact surfaces for supports 20, illustrated in this embodiment as rollers. Each roller 20 is supported on the lever 18 by an axle 21 which extends in a direction transverse to the direction of movement of frame 12. Springs 17 thus urge support or contact members 20 into abutment with guide tracks 19 and thereby urge frame 12 and plate 10 toward plate 7.

In accordance with a unique feature of the present invention, each lever 18 and the respective spring 17 is arranged in an elongated configuration extending in a direction substantially parallel to the direction of movement of frame 12. Thus, the levers and springs do not extend outwardly from the frame. Furthermore, as particularly shown in FIG. 3, the levers are mounted beneath the guide tracks. As a result, the overall dimensions of the sliding closure unit are reduced in comparison with known arrangements.

As shown in FIG. 1, the contact members of the two levers 18 on each side of the frame are directed toward each other. Furthermore, all of the contact members are located symmetrically with respect to discharge opening 8. As a result, the contact pressure between the two plates is maintained uniform around discharge opening 8 at all relative positions of plate 10 and frame 12. It is at this area around discharge opening 8 that the ferrostatic pressure of the molten metal acts. By ensuring that the contact pressure is symmetrical in this area, uniform sealing is ensured. Additionally, as will be apparent from the drawings, spring 17 are positioned at locations outside the path of movement of frame 12.

Figure 4:
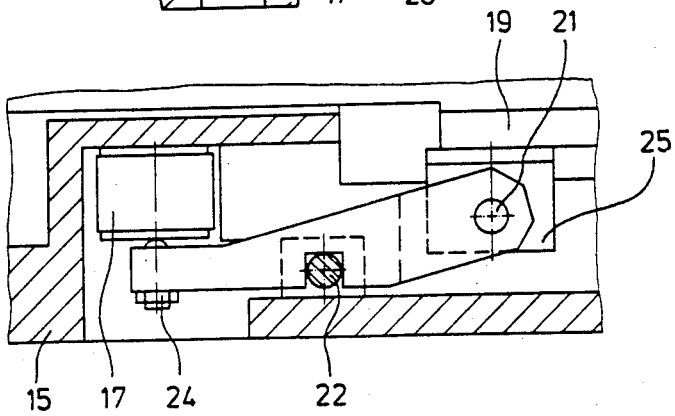
FIG. 4 is an enlarged partial view showing a modification of a lever contact member structure.

FIG. 4 illustrates an alternative construction of the support or contact members. Thus, rollers 20 of FIGS. 1–3 are replaced by shoes 25 which are not likely to become soiled and which have surfaces complementary to guide tracks 19. FIG. 4 also illustrates the provision of adjusting bolts 24 to adjust the spring force applied to the lever 18 and thereby by the contact member to the frame.

In accordance with a further modification of the present invention it would be possible to provide the levers as one-arm levers rather than double-arm levers as shown. In such modification, axles 22 would be provided on the end of the lever without the contact member, and the spring would be positioned adjacent the end of the lever having the contact member. It additionally would be possible to provide guide tracks 19 integrally of frame 12, rather than as separate elements as shown.

Figure 5:
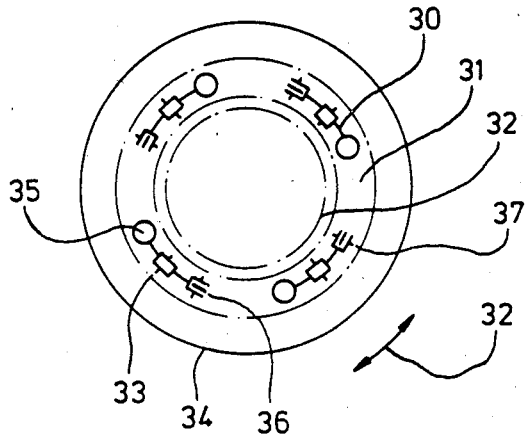
FIG. 5 is a schematic plan view of a further embodiment of the present invention employing a movable frame and movable refractory plate which are mounted for rotary movement.

The present invention equally is employable with sliding closure units incorporating rotary movement or swivel movement, rather than rectilinear movement as is the case in the embodiment of FIGS. 1–4. Thus, FIG. 5 illustrates somewhat schematically a lever arrangement for a sliding closure unit capable of rotary movement. Thus, levers 30 are mounted in alignment with a circular guide track 31 of a rotary movable frame 32 carrying a rotary movable refractory plate (not shown) and indicated by dashed lines. To achieve pressing of the rotary refractory plate against the stationary refractory plate, frame 32 is supported elastically by levers 30 loaded by respective springs 35 and mounted in cover member 34 to pivot about axles 33 extending transverse of guide track 31, i.e. radially of the axis of rotary movement. For functional reasons, axles 37 of rollers 36 forming contact members also extend radially. Axles 37 of course would not be employed if the contact members were in the forms of shoes, in a manner similar to that of FIG. 4.

Although the present invention has been described and illustrated with respect to preferred embodiments and features, it is to be understood that various changes and modifications may be made to the specifically described and illustrated features without departing from the scope of the present invention.

I claim:

1. In a sliding closure unit for controlling the discharge of molten metal from a metallurgical vessel, said sliding closure unit including a stationary refractory plate having therethrough a discharge opening, a stationary housing assembly for mounting said stationary refractory plate on the metallurgical vessel, a movable refractory plate having therethrough a discharge opening, said stationary and movable refractory plates having complementary, abutting relative sliding surfaces, a movable frame mounting said movable refractory plate for movement with respect to said stationary refractory plate, said movable frame including guide means cooperable with said housing assembly for guiding movement of said movable frame, and means for pressing said movable refractory plate toward said stationary refractory plate, the improvement wherein said pressing means comprises:

two pairs of levers mounted in said housing assembly for pivotal movement about axles fixed to said housing assembly and extending transverse to the direction of movement of said movable frame and said movable refractory plate;

spring means, mounted in said housing assembly, for urging said levers to pivot about respective said axles against said guide means and toward said movable frame and thereby for urging said movable frame and said movable refractory plate toward said stationary refractory plate;

each said lever and the respective said spring means being arranged in an elongated configuration extending in a direction substantially parallel to said direction of movement; and at least said levers being positioned below said guide means.

2. The improvement claimed in claim 1, wherein said guide means are movable in said direction of movement of said movable frame.

3. The improvement claimed in claim 1, wherein said housing assembly includes a housing member to be fixed to the metallurgical vessel and a cover member pivotally mounted on said housing member for movement relative thereto between open and closed positions, and said levers, said axles and said spring means are mounted within said cover member.

4. The improvement claimed in claim 3, wherein said movable frame is mounted for rotary movement about an axis, and said axles extend radially of said axis.

5. The improvement claimed in claim 3, wherein said movable frame is movable rectilinearly, said guide means comprise a rectilinear guide track located at each of opposite sides of said movable frame and extending parallel to said direction of movement, two said levers and respective spring means are positioned beneath each said guide track, and each said lever has at a first end thereof a contact member urged by the respective said spring means into abutment with the respective said guide track.

6. The improvement claimed in claim 5, wherein said contact members are located symmetrically with respect to said discharge opening of said stationary refractory plate.

7. The improvement claimed in claim 5, wherein said two levers beneath each said guide track are positioned with said first ends thereof directed toward each other.

8. The improvement claimed in claim 5, wherein said spring means are positioned in said cover member at locations beyond the path of movement of said movable frame.

9. The improvement claimed in claim 5, wherein said contact members comprise rollers.

10. The improvement claimed in claim 5, wherein said contact members comprise shoes having surfaces complementary to said guide tracks.

11. The improvement claimed in claim 5, wherein said guide tracks are formed integrally with said movable frame.

* * * * *